US008157022B2

(12) United States Patent
Bertoja et al.

(10) Patent No.: US 8,157,022 B2
(45) Date of Patent: Apr. 17, 2012

(54) APPARATUS STRING FOR USE IN A WELLBORE

(75) Inventors: Michael J. Bertoja, Pearland, TX (US); Luis Ochoa, Sugar Land, TX (US); Kenneth R. Goodman, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 556 days.

(21) Appl. No.: 11/863,707

(22) Filed: Sep. 28, 2007

(65) Prior Publication Data

US 2009/0084535 A1 Apr. 2, 2009

(51) Int. Cl.
*E21B 43/1185* (2006.01)
*E21B 43/11* (2006.01)
*E21B 43/116* (2006.01)

(52) U.S. Cl. ..... 175/4.54; 175/4.55; 166/55; 166/55.1

(58) Field of Classification Search ..... 175/4.54, 175/4.55; 166/55, 55.1
See application file for complete search history.

(56) References Cited

U.S. PATENT DOCUMENTS

| | | | | |
|---|---|---|---|---|
| 6,041,864 | A | 3/2000 | Patel et al. | |
| 6,564,866 | B2 * | 5/2003 | Clark et al. | 166/250.12 |
| 6,820,693 | B2 | 11/2004 | Hales et al. | |
| 6,837,310 | B2 | 1/2005 | Martin | |
| 6,955,217 | B2 * | 10/2005 | Clark et al. | 166/250.01 |
| 7,108,073 | B2 | 9/2006 | Patel | |
| 7,152,676 | B2 | 12/2006 | Vella et al. | |
| 7,273,102 | B2 | 9/2007 | Sheffield | |
| 7,383,882 | B2 * | 6/2008 | Lerche et al. | 166/250.01 |
| 8,074,737 | B2 * | 12/2011 | Hill et al. | 175/4.55 |
| 2002/0088620 | A1 * | 7/2002 | Lerche et al. | 166/297 |
| 2002/0112860 | A1 * | 8/2002 | McDaniel | 166/381 |
| 2003/0098157 | A1 | 5/2003 | Hales et al. | |
| 2003/0098799 | A1 | 5/2003 | Zimmerman | |
| 2005/0045331 | A1 * | 3/2005 | Lerche et al. | 166/297 |
| 2005/0263286 | A1 * | 12/2005 | Sheffield | 166/297 |
| 2007/0050144 | A1 | 3/2007 | Grove et al. | |
| 2008/0053658 | A1 * | 3/2008 | Wesson et al. | 166/297 |
| 2009/0084535 | A1 * | 4/2009 | Bertoja et al. | 166/55.2 |
| 2009/0272529 | A1 * | 11/2009 | Crawford | 166/250.15 |

FOREIGN PATENT DOCUMENTS

| | | | |
|---|---|---|---|
| GB | 2383236 | A | 6/2003 |
| GB | 2414494 | A | 11/2005 |

* cited by examiner

*Primary Examiner* — Jennifer H Gay
(74) *Attorney, Agent, or Firm* — Chadwick A. Sullivan

(57) ABSTRACT

An apparatus string for use in a wellbore has a plurality of activation modules having first and second ends and containing devices to be activated/initiated downhole. An apparatus string also has a plurality of initiator modules where at least initiator is operatively connected to each activation module and is addressable. Each initiator module may have a safety initiator which when the initiator module is addressed initiates the firing of the shaped charges in the gun module to which it is operatively connected. A wireless transmitter is operatively connected in and integral to the apparatus string for use in transmitting signals to address any initiator module in the apparatus string.

21 Claims, 2 Drawing Sheets

APPARATUS STRING FOR USE IN A WELLBORE

TECHNICAL FIELD

The present application relates to an apparatus string for use in a wellbore, where the apparatus string may, for example, comprise a perforating string.

BACKGROUND

For purposes of enhancing production from a subterranean formation, a perforating gun is typically lowered down into a wellbore that extends through the formation. A perforating gun typically comprises a plurality of gun sections where each gun section comprises a plurality of radially-oriented shaped charges which are detonated to form perforations in the formation proximate the wellbore. These shaped charges may, for example, be placed at points on a helical spiral that extends along the longitudinal axis of each gun section of the perforating gun.

In wireline guns, there are normally two wires that run the length of the gun string. One of these wires is a live or hot wire which is connected to a positive or negative voltage, and the other wire is a ground wire. These wires connect a source of current and voltage which is located at or near the earth's surface to an electrical detonator in the body of the perforating gun. The electrical detonator is the apparatus that initiates the ballistic train including the detonating cord and subsequently the shaped charges which will perforate the well and permit flow between the reservoir in the formation and the wellbore. The typical initiation system used for a perforating gun string usually also requires ballistics to be run from gun to gun when running several guns in a string.

The presence of the wires not only decreases the amount of space in the gun for shaped charges but also increases the amount of time required to load a gun. If a wire gets pinched or shorts out during a loading or transportation process, the wires must be replaced and reinstalled in the gun, which also increases the time necessary for loading.

Typically, the components of perforating guns except the detonator are assembled at one location and then shipped to a second location where the perforating operation is to be conducted. At that second location, a port is opened in the loading tube and a detonator is installed. The detonator may, for example, be a SECURE™ detonator which is provided by the assignee of the present application, and this detonator includes an addressable switch, a fireset and an initiator. Accordingly, the installation of the detonator assembly at the site where perforating is to take place involves the connection of a number of wires in a very small space. The installation of the detonator also requires the utilization of a safety tube in which the detonator is placed before connection of the detonator to the wiring in the loading tube.

Usually a perforating string will comprise a plurality of perforating guns. The activation of the guns in such a string will normally be from the lowermost gun section to the topmost gun section. If, for example, a perforating string has three gun sections and the middle section is activated first, the activation of the middle section destroys the wires in the middle section, and communication between the earth's surface and the lowermost gun section no longer is possible.

Apparatus comprising a safe system that does not require wires or ballistics to run through each gun in a perforating string would bring a substantial benefit in efficiency, service quality and safety to the perforating operation. Also, a perforating string that does not require the installation of a detonating device at the perforating site would be beneficial both for efficiency and safety. Further, a perforating string in which the gun sections could be activated in any order would be beneficial.

Many of the issues noted above have been addressed by embodiments of the present invention.

SUMMARY

An embodiment of the present invention relates to an apparatus string that comprises a wireless transmitter that is an integral part of the apparatus string. An apparatus string according to the present invention further comprises a wireless initiation system that can receive commands from the aforesaid wireless transmitter.

In one embodiment, an apparatus string for use in a wellbore is provided which comprises a plurality of activation modules. Each of the activation modules has first and second ends and comprises devices to be activated/initiated downhole. An apparatus string according to the present invention further comprises a plurality of battery-operated, addressable initiators, where at least one initiator is operatively connected to each activation module to activate/initiate the devices in said activation module when said initiator is addressed. A wireless transmitter is provided which is integral with the apparatus string. The wireless transmitter receives commands from the earth's surface and transmits signals to address the initiators in the apparatus string in any order.

In one embodiment, an initiator is operatively connected to the first end of each activation module, while in another embodiment an initiator is operatively connected to the second end of each activation module. In yet another embodiment, an initiator is operatively connected to both the first and second ends of each activation module.

In a further embodiment, the devices in the activation modules of the apparatus string are selected from the group consisting of perforating guns, setting tools, apparatus to dump cement, sensors and propellant devices. However, an apparatus string according to the present invention is not limited to such devices and may be utilized with any devices requiring initiation/activation downhole.

In one embodiment of the present invention, an apparatus string according to the present invention comprises a perforating string having a plurality of gun modules. Each gun module has a first end and a second end and comprises a plurality of shaped charges which are distributed at spaced locations in the gun module and which are interconnected by a detonating cord. Apparatus in accordance with the present invention further comprises a plurality of battery-operated, addressable initiator modules where at least one initiator module is operatively connected to each gun module. An initiator module according to the present invention comprises all of the safety features required to assemble the initiator module to a gun module. When a particular initiator module is addressed, a safety initiator in that module is activated which initiates the firing of the shaped charges in the gun module to which the addressed initiator module is operatively connected.

An apparatus according to the present invention further comprises a wireless transmitter which is operatively connected in and integral to the perforating string for use in transmitting signals to address any of the initiator modules in the perforating string.

In one embodiment, an initiator module is operatively connected to the first end of each gun module, while, in a second embodiment, an initiator module is operatively connected to the second end of each gun module. In yet another embodiment, initiator modules are operatively connected to both the first and second ends of each gun module in the perforating string.

The safety initiator in the initiator modules in the perforating string may, for example, be an electromechanical frequency interface (EFI) or an exploding bridgewire (EBW) device.

In accordance with an embodiment, an apparatus is provided for use in a perforating string where said apparatus is assembled at a location other than the location at which the perforating operation will be performed. The apparatus comprises a gun module having first and second ends. The gun module comprises a plurality of shaped charges distributed at spaced intervals and a detonation cord interconnecting those shaped charges. A battery-operated, addressable initiator module is operatively connected to either or both ends of the gun module, and the initiator module comprises circuitry which detects that the initiator module has been addressed. A safety initiator device in the initiator module is activated when the initiator module is addressed, which initiates the firing of the shaped charges in the gun module.

The initiator module may comprise a safety initiator which is either an EFI device or an EBW device.

DETAILED DESCRIPTION

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
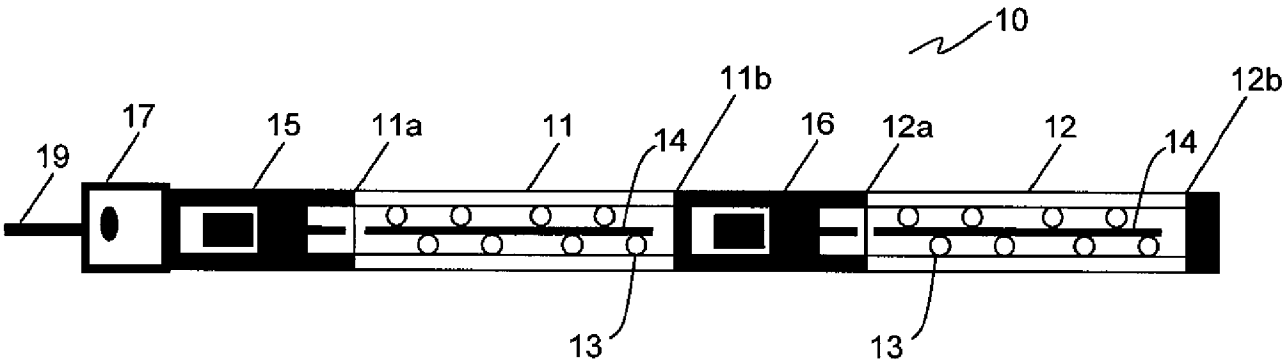
FIG. 1 is a schematic diagram illustrating in cross-section one embodiment of apparatus in accordance with the present invention.

With reference first to FIG. 1, an apparatus string 10 for use in a wellbore is provided which comprises a plurality of activation modules 11, 12. Each of the activation modules 11, 12 has first and second ends 11*a* and 11*b* and 12*a* and 12*b*, respectively and comprises a plurality of devices 13 to be activated downhole.

In FIG. 1, apparatus string 10 may, for example, comprise a perforating string comprising a number of activation modules 11 and 12, where each activation module 11, 12 comprises a plurality of shaped charges 13 which are distributed at spaced locations in the gun modules and which are interconnected by detonation cord 14.

Still referring to FIG. 1, the apparatus string 10 has a plurality of battery-operated, addressable initiators 15 and 16, where at least one initiator 15, 16 is operatively connected to each activation module 11, 12. The initiators 15, 16 could alternatively receive electrical power transmitted through well fluids or other well components, excluding the aforementioned wire configuration. For example, electrical current could be transmitted through a well casing or other conductive components extending downhole. Each of the initiators 15, 16 can have a unique address, and when one of the initiators, e.g. 15, is addressed, activation of the devices occurs in the activation module 11 to which the addressed initiator is operatively connected. For example, when apparatus string 10 comprises a perforating string, the addressing of initiator 15 causes the initiation of the shaped charges 13 in the activation module 11 to which the initiator 15 is operatively connected. A booster (not shown) may advantageously be coupled between the initiators 15, 16 and the activation module with which the booster is associated to assist in the detonation. Each initiator 15, 16 can have a safety initiator device which may, for example, be an EFI or an EBW device.

The apparatus string 10 can have a wireless transmitter 17 that is operatively connected to an integral part of apparatus string 10. Wireless transmitter 17 can receive communication signals from earth's surface via communication medium 19 and can function to address the initiator module to be activated. Such commands may, for example, be transmitted via pressure, flow tension, acoustic or electromagnetic signals.

For example, when the apparatus string 10 of the present invention comprises a perforating string, wireless transmitter 17 can receive commands which identify the activation module to be initiated. Assuming that activation module 11 is to be initiated; wireless transmitter 17 can receive and transmit signals which address initiator 15. The addressing of initiator 15 can cause the activation of the safety initiator device therein, which in turn activates the detonating cord 14 in activation module 11, thereby firing the shaped charges 13 in gun module 11. Similarly, wireless transmitter 17 may address initiator 16. This can cause the activation of the safety initiator in initiator 16 which in turn initiates the detonation cord 14 in activation module 12, thereby firing shaped charges 13 contained therein.

When the apparatus string 10 is a perforating string, preferably detonation wires or ballistics do not extend between adjacent gun modules. Also, it is advantageous to configure the apparatus string 10 and associated devices so that gun modules contained in the perforating string may be activated in any order. Also, the initiator 16 can be configured to provide a pressure barrier between gun modules 11 and 12.

Figure 2:
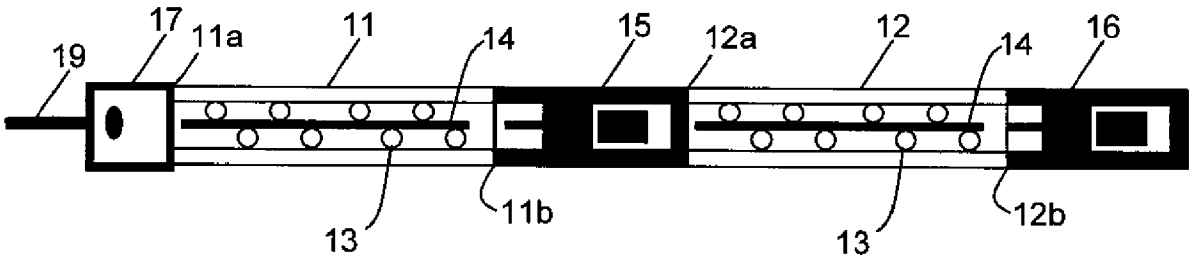
FIG. 2 is a schematic diagram illustrating in cross-section a second embodiment of apparatus according to the present invention.
Figure 3:
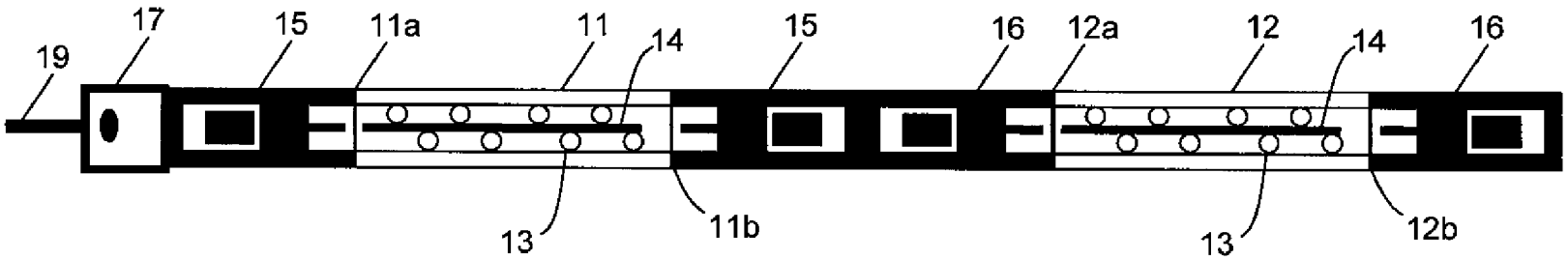
FIG. 3 is a schematic diagram illustrating in cross-section a third embodiment of apparatus in accordance with the present invention.

FIG. 1 shows the initiator 15 being operatively coupled to the first end 11*a* of activation module 11 and initiator 16 is coupled to the first end 12*a* of activation module 12. In an alternative embodiment, initiators 15 and 16 may be operatively coupled to the second ends 11*b* and 12*b* of activation modules 11 and 12, respectively, as illustrated in FIG. 2. In yet another embodiment, initiators 15 and 16 may be coupled to both ends of activation modules 11 and 12, respectively, as illustrated FIG. 3.

In addition to being perforating guns, the features described herein may also be applied to setting tools, apparatus to dump cement, and propellant devices, or any other devices that are required to be activated once the apparatus string 10 is downhole.

Figure 4:
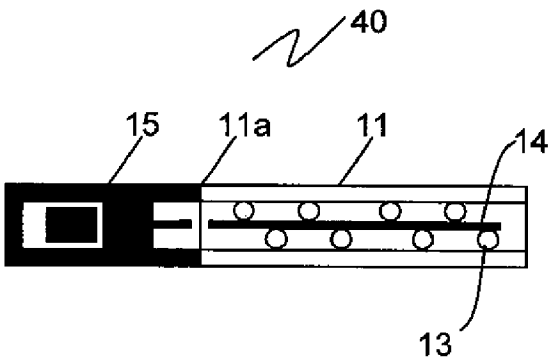
FIG. 4 is a schematic diagram in cross-section of apparatus for use in a perforating string.

With reference now to FIG. 4, a plurality of modules 40 may be assembled at a first location that is not the site at which perforating operations are to be performed. Each module 40 can be a gun section 11 as described above to which is coupled an initiator module 15, also as described above. Modules 40, once assembled, may be transported safely to the site at which perforating operations are to be performed, thereby alleviating a requirement to install detonators at that point.

What is claimed is:

1. An apparatus string for use in a wellbore, the apparatus string comprising:

a plurality of activation modules, each of said activation modules having first and second ends and comprising a device to be activated/initiated downhole;

a plurality of battery-operated addressable initiators, where at least one of the plurality of initiators is operatively connected to at least one of the plurality of activation modules to activate/initiate said activation module when said initiator is addressed; and a wireless transmitter that is connected with and adjacent to the plurality of activation modules module, that receives configured to receive signals from the earth's surface and transmit signals to address the initiators in the apparatus string and signals to activate said activation modules, wherein the plurality of activation modules, the plurality of battery-operated addressable initiators and the wireless transmitter are configured to be positioned within a wellbore.

2. The apparatus string of claim 1, wherein the devices of the activation modules comprise perforating guns.

3. The apparatus string of claim 1, wherein one of the plurality of initiators is operatively connected to the first end of one of the plurality of activation modules.

4. The apparatus string of claim 1, wherein an initiator is operatively connected to the second end of each activation module.

5. The apparatus string of claim 1, wherein an initiator is operatively connected to the first and second ends of each activation module.

6. The apparatus string of claim 1, wherein each of the plurality of initiators comprises an electromechanical frequency interface (EFI) device.

7. The apparatus string of claim 1, wherein each of the plurality of initiators comprises an exploding bridgewire (EBW) device.

8. A perforating string for being positioned within a wellbore, the perforating string comprising:

a plurality of gun modules where each gun module in said plurality of gun modules has first and second ends and comprises a plurality of shaped charges and a detonating cord which interconnects said plurality of shaped charges;

a plurality of initiator modules, where at least one of the plurality of initiator modules is operatively connected to at least one of the plurality of gun modules and where each initiator module of said plurality of initiator modules is addressable and comprises a safety initiator, which when the initiator module is addressed, initiates the firing of the shaped charges in the gun module to which the initiator module is operatively connected; and a wireless transmitter connected with and adjacent to at least one of the initiator modules of the perforating string for use in receiving activation signals and transmitting signals to select initiator modules in the perforating string.

9. The perforating string of claim 8, wherein at least one of the plurality of initiator modules is operatively connected to the first end of each gun module.

10. The perforating string of claim 8, wherein an initiator module is operatively connected to the second end of each gun module.

11. The perforating string of claim 8, wherein initiator modules are operatively connected to the first and second ends of each gun module.

12. The perforating string of claim 8, wherein the plurality of initiator modules is battery operated.

13. The perforating string of claim 8, wherein the safety initiator in each of the plurality of initiator modules is an electromechanical frequency interface (EFI) device.

14. The perforating string of claim 8, wherein the safety initiator in each of the plurality of initiator modules is an exploding bridgewire (EBW) device.

15. Apparatus for use in a perforating string where said apparatus is assembled at a location other than the perforating location, comprising:

a gun module having a first end and a second end and comprising a plurality of shaped charges and a detonation cord interconnecting said shaped charges;

an initiator module which is operatively connected to one end of the gun module, where the initiator module comprises (i) circuitry for addressing the initiator module and (ii) a safety initiator, which when the initiator module is addressed, provides initiation signals to the detonation cord in the gun module; and a wireless transmitter connected with and adjacent to the initiator module of the perforating string for use in receiving activation signals and transmitting signals to the initiator module in the perforating string.

16. The apparatus of claim 15, wherein the initiator module is operatively connected to the first end of each gun module.

17. The apparatus of claim 15, wherein the initiator module is operatively connected to the second end of each gun module.

18. The apparatus of claim 15, further comprising a second initiator device is operatively connected to the other end of the gun module.

19. The apparatus of claim 15, wherein the initiator module is battery operated.

20. The apparatus of claim 15, wherein the safety initiator in the initiator module is an electromechanical frequency interface (EFI) device.

21. The apparatus of claim 15, wherein the safety initiator in the initiator module is an exploding bridgewire (EBW) device.

* * * * *